US007384284B2

(12) United States Patent
Denz et al.

(10) Patent No.: US 7,384,284 B2
(45) Date of Patent: Jun. 10, 2008

(54) ELECTRICAL STRIP CONNECTOR WITH LEVER ASSIST

(75) Inventors: Alexander Denz, Feldkirch (AT); Thomas Burk, Bad Liebenzell (DE)

(73) Assignee: Hirschmann Automotive GmbH, Rankweil/Brederis (AT)

( * ) Notice: Subject to any disclaimer, the term of this patent is extended or adjusted under 35 U.S.C. 154(b) by 0 days.

(21) Appl. No.: 11/521,061

(22) Filed: Sep. 13, 2006

(65) Prior Publication Data

US 2007/0059960 A1 Mar. 15, 2007

(30) Foreign Application Priority Data

Sep. 13, 2005 (DE) ..... 10 2005 043 846

(51) Int. Cl.
*H01R 13/62* (2006.01)

(52) U.S. Cl. ..... 439/157; 439/372

(58) Field of Classification Search ..... 439/157, 439/159–160, 372, 153
See application file for complete search history.

(56) References Cited

U.S. PATENT DOCUMENTS 5,401,179 A * 3/1995 Shinchi et al. ..... 439/157

* cited by examiner

*Primary Examiner*—Javaid H. Nasri
(74) *Attorney, Agent, or Firm*—Andrew Wilford

(57) ABSTRACT

An electrical connector has a multiconductor plug strip and a multiconductor socket strip fittable complementarily and transversely with the plug strip. A pivot seat on one of the strips defines a pivot axis, and a lever formed with a pivot is fittable with the seat and pivotal on the one strip about the axis. An actuating formation on the lever offset from the axis and another actuating formation on the other strip are engageable with each other when the other strip is at least partially fitted to the one strip to disengage and engage the strips with each other.

12 Claims, 6 Drawing Sheets

ELECTRICAL STRIP CONNECTOR WITH LEVER ASSIST

FIELD OF THE INVENTION

The present invention relates to an electrical strip connector. More particularly this invention concerns such a connector comprised of a multiconductor plug strip and a complementary socket strip.

BACKGROUND OF THE INVENTION

For multiconductor plug-in electrical connections it is standard to use one-row or multirow plug strips and complementary socket strips. To facilitate joining and disconnecting them, it is known to provide a lever that can be pivoted in one direction to fit and lock them together and oppositely to separate them. The forces required for the joining or separation are applied by means of this lever and the rotary motion thereof, thus enabling this assembly or disassembly to be performed more easily or with only a small force, and also without tools.

Such assist levers are typically fairly complex multipart elements that considerably increase the manufacture cost of the strip connector. In addition they are frequently somewhat susceptible to failure when fouled. Thus they are not appropriate for motor-vehicle use, where the connectors frequently are covered with road dirt and the like.

OBJECTS OF THE INVENTION

It is therefore an object of the present invention to provide an improved electrical strip connector with lever assist.

Another object is the provision of such an improved electrical strip connector with lever assist that overcomes the above-given disadvantages, in particular that is of simple and durable construction, and that is relatively insensitive to bad environmental conditions so that it is suitable for motor-vehicle use.

SUMMARY OF THE INVENTION

An electrical connector has according to the invention a multiconductor plug strip, a multiconductor socket strip fittable complementarily and transversely with the plug strip, a pivot seat on one of the strips defining a pivot axis, a lever formed with a pivot fittable with the seat and pivotal on the one strip about the axis, an actuating formation on the lever offset from the axis, and another actuating formation on the other strip engageable with the lever actuating formation and displaceable thereby when the other strip is at least partially fitted to the one strip to disengage and engage the strips with each other.

In other words, the lever has a pivot pin by means of which the lever is rotatably mounted on the plug strip (or the socket strip), and also has an eccentric actuating pin that cooperates with a guide ridge on the socket strip (or the plug strip) during the joining or separation. In other words, the present invention makes use of the fact that the lever is rotatably mounted on the plug strip (or alternatively, the socket strip, although mounting on the plug strip is assumed below) and is provided outside the rotational axis, i.e. eccentric, of the actuating pin that acts on the socket strip when the lever is actuated, thereby causing the socket strip to move relative to the plug strip, i.e., pulled into the plug strip, during assembly and moved away from same during disassembly.

In this manner a robust structure is provided, since none of the elements involved in the assembly or disassembly are able to tilt or break off or be hindered in their motion as the result of contaminants or the like. It is also possible to attach one or more guide ridges on the opposite side of the insertion mechanism to prevent tilting. As a result of mounting the lever on the plug strip by means of the pivot pin, the lever is always able to rotate relative to the plug strip. The same is true for the actuating pin that cooperates with the guide ridge, in particular with the two parallel ridges thereof, on the socket strip. This design also precludes dirt particles in particular from preventing motion, since these are pushed off this guide ridge by the actuating pin. A further advantage is the simple manufacture of the plug strip, socket strip, and lever when these are made of plastic and manufactured in a plastic injection-molding process. It is thus possible to manufacture the system of this invention in large quantities once the injection molding tools required for the plug strip, socket strip, and lever are available.

In accordance with the invention the lever has locking formations that cooperate with locking formations formed on the plug or socket strip. This ensures that after the plug strip and socket strip are joined by pivoting the lever, these two strips are inseparably connected or locked together, this locking being achieved not only by the rotation of the lever but also by the locking connection of the lever on the plug strip (or alternatively, the socket strip). This detachable connection via locking means has the advantage that on the one hand the socket strip can no longer separate from the plug strip during use of the plug connection, and on the other hand disassembly, i.e. separation of the plug and socket strips, is enabled once again after the locking connection, in particular a two-stage locking connection, is released. Two-stage locking is particularly advantageous when it occurs in the same direction of motion or in two different directions of motion, in particular a vertical direction of motion and a direction of motion perpendicular thereto, that is biaxially.

According to another feature of the invention, the locking means provided on the plug strip or the socket strip, or the locking means provided on the lever, are elastically deformable. This deformability has the advantage that either one-stage or two-stage locking is possible without great expenditure of force, and in addition tolerances are compensated for and the locking means are under mutual pretension after being locked, so that loosening of the lock, in particular under severe environmental conditions such as those occurring in automotive engineering, does not result in release of the lock.

With the instant invention, the plug strip and the socket strip are designed so that they may be fitted together in only one angular position relative to one another, for which purpose the plug strip and the socket strip have corresponding coding formations. This primarily prevents incorrect positioning of the socket strip in the plug strip, since as a rule the lever acts on only one side of the two strips, a two-sided design of the assembly or disassembly mechanism also being possible. Faulty electrical connection is also thus prevented, since only the contact partners for the plug strip may be connected to the corresponding contact partners for the socket strip, thereby preventing confusion.

According to the invention, the lever has a tab and the plug strip has a catch hook by means of which the lever may be fixed in an intermediate prelocking position after being mounted on the socket strip (plug strip). First, the plug strip, socket strip, and lever are manufactured separately, for example in a plastic injection molding process. Then the plug strip and the socket strip together with their associated contacts (plug, socket, or other elements, for example) are provided (alternatively, the lever may also be mounted before the contacts are installed), and then the lever is mounted on the plug strip. The lever may assume three different positions, for example, with respect to the plug strip. In a first position, the lever and plug strip are designed such that the lever can be fitted to or on the plug strip in only one specific position. After this is done, the lever is brought into a second position, for example the referenced prelocking position, which may be achieved in particular by rotation or another type of motion. In this prelocking position it is no longer possible to separate the lever from the plug strip. On the other hand, however, the socket strip may be inserted, although not completely, into the plug strip. The socket strip must be inserted far enough into the plug strip that the actuating pin of the lever is able to cooperate with the guide ridge. A further rotational motion (or another motion) of the lever from the second position into a third position, in particular the end position of the lever, causes the socket strip to be pulled into the plug strip as the result of the eccentric actuating pin, and to be fixed in place at that location. When the end position is reached, the lever together with its locking means is also brought into connection with the corresponding locking means on the plug strip, and is permanently or detachably fixed in place in that locked position.

It is possible, although for handling such a plug-in connection it is less advantageous, for the installation position and the prelocking position of the lever on the plug strip to coincide. When there is too little installation space in the region of the plug strip, as an alternative the catch hook may be mounted on the socket strip.

BRIEF DESCRIPTION OF THE DRAWING

The above and other objects, features, and advantages will become more readily apparent from the following description, reference being made to the accompanying drawing in which.

SPECIFIC DESCRIPTION

Figure 3:
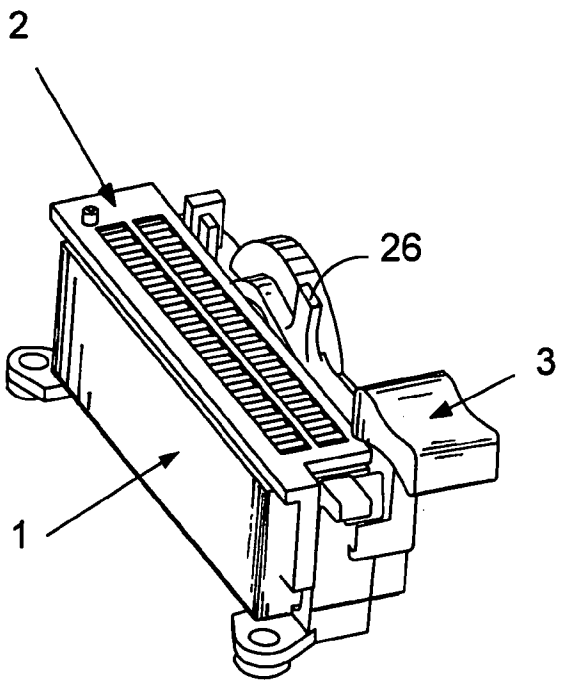
FIGS. 1, 2, and 3 show the connector according to the invention in an assembly, prelocking, and locked position, respectively.

As seen in FIG. the drawing a strip-type electrical connector according to the invention has a plug strip 1; a socket strip 2, and a lever 3 rotatably mounted on the plug strip 1. The lever 3 is used to reduce the assembly or disassembly forces that arise when the socket strip 2 is joined to or separated from the plug strip 1. The lever 3 has a pivot pin 21 defining an, axis A and adapted to fit into a complementary circular hole 4 formed in the plug strip 1. The lever 3 has, relative to the axis A, a foot forming a radially outwardly directed part-circular guide surface 22, a secantal planar edge surface 23, an axially directed planar side face 24, and an axially opposite planar side face 25 parallel to the face 24. The plug strip 1 has complementary surfaces 5, 6, 7, 31. The pivot pin 21 is fitted to the pivot hole 4 in the plug strip 1.

Figure 2:
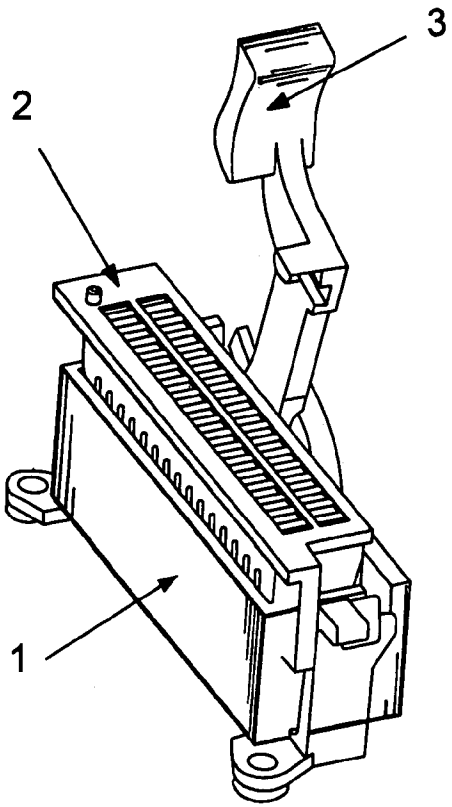
Figure 1:
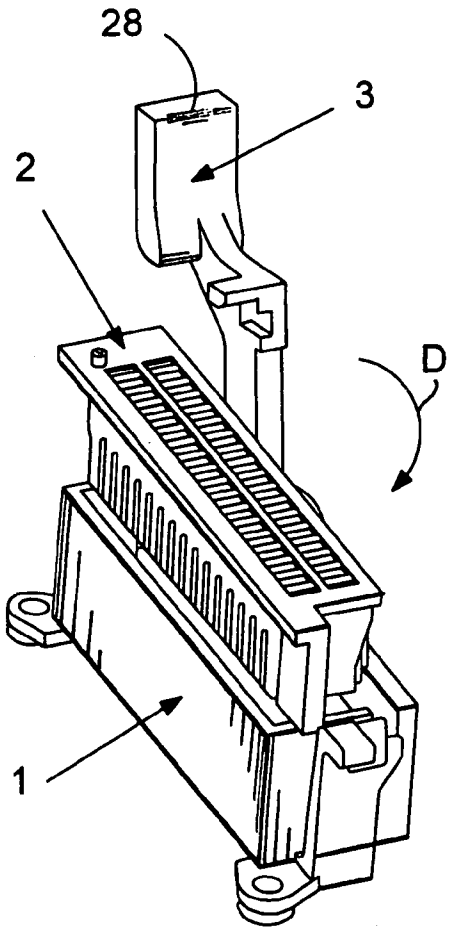
Figure 4A:
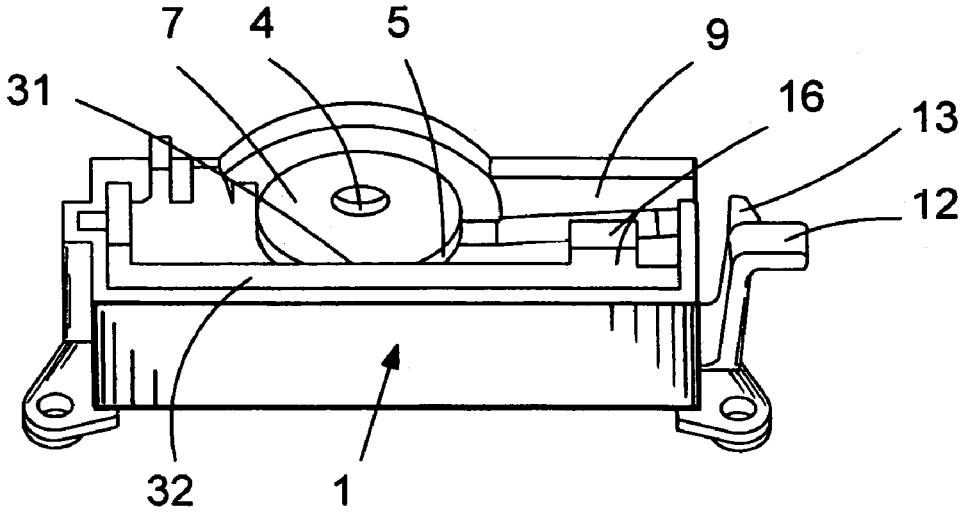
FIGS. 4A, 4B, 4C, and 4D are various perspective views of the plug strip according to the invention.
Figure 4B:
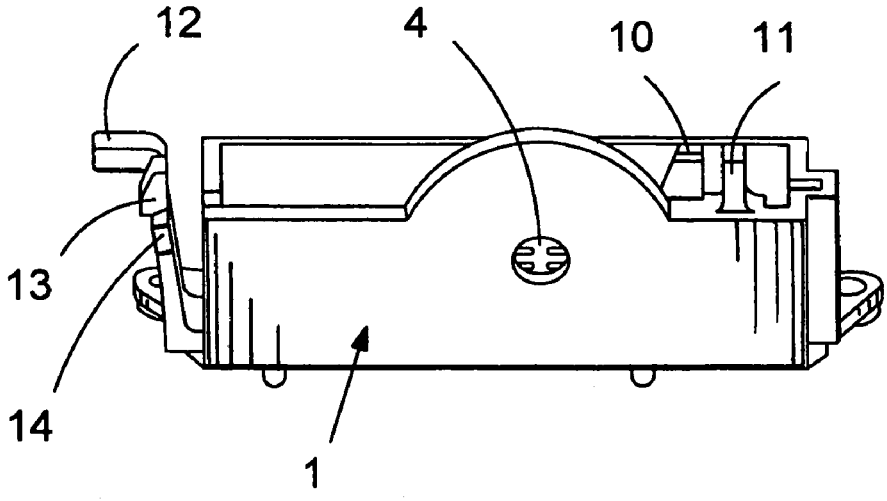
Figure 4C:
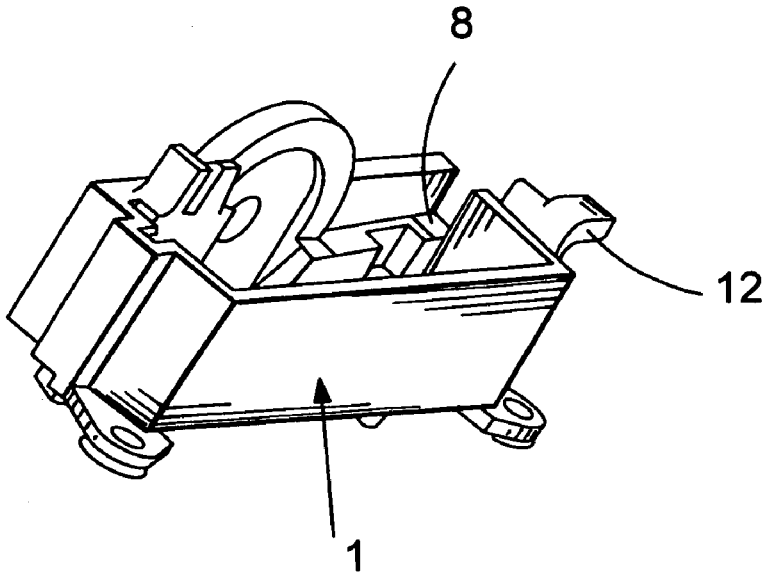
Figure 4D:
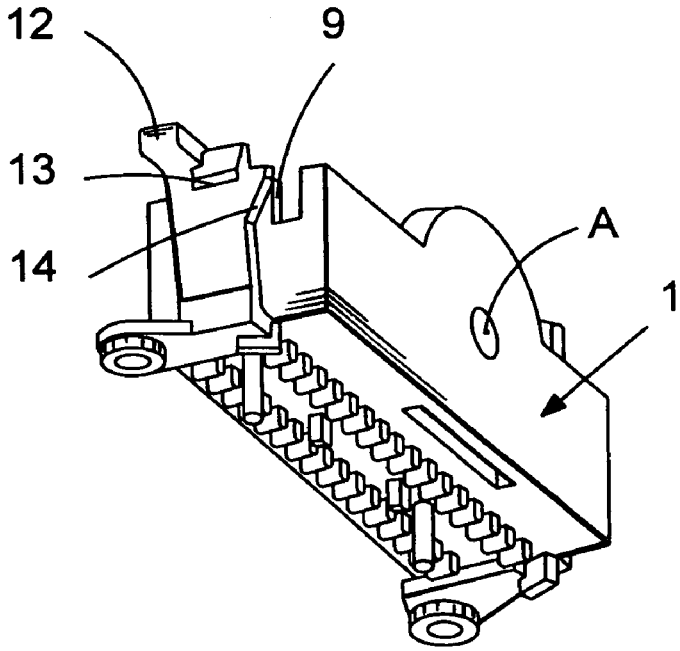
Figure 5A:
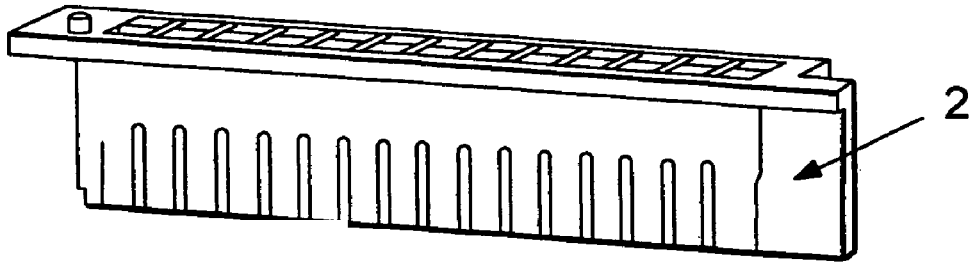
FIGS. 5A and 5B are views of opposite sides of the socket strip.
Figure 5B:
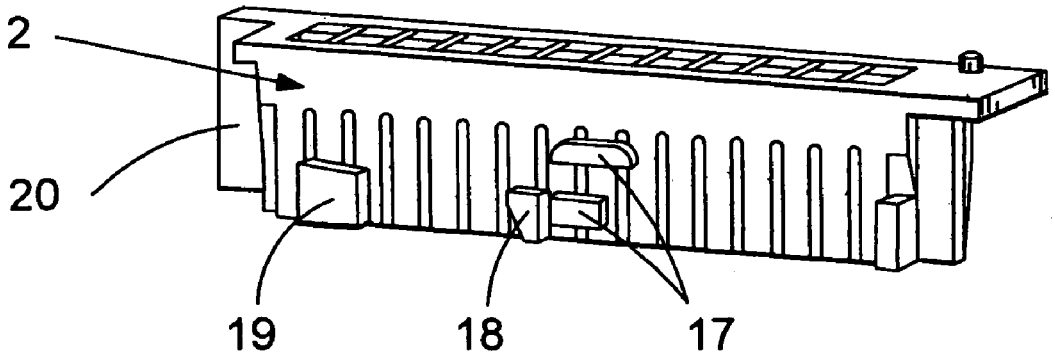
Figure 6:
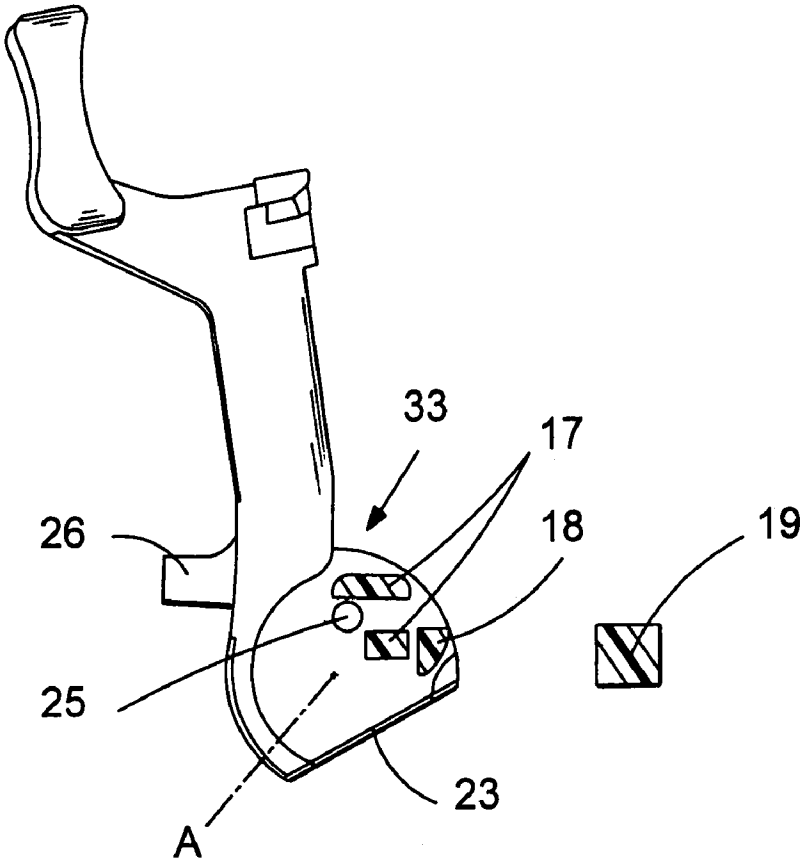
FIG. 6 is a side partly diagrammatic view illustrating the lever and associated structure.

The lever 3 can be fitted to the plug strip 1 in a loading position (see FIG. 1). In this position the flat edge 23 just slides in surface contact atop a flat edge 32 of the plug strip 1 while allowing the pin 21 to fit into the hole 4. Slight pivoting of the lever 3 into the prelocking position (see FIG. 2) dips the part-circular foot of the lever 3 into the strip 1 and makes it impossible for the pin 21 to pull out of the hole 4. In this position the lever 3 is also held by a positive-fit lock between a catch formation 10 on the plug strip 1 and a tab 26 on the lever 3. An adjacent tab 11 is used to protect the catch hook 10.

After the socket strip 2 has been partially inserted in the plug strip 1 (see FIGS. 1 and 2; the socket strip 2 should basically only be placed in position in the plug strip, since the lever is not held in position by the plug strip) and the lever 3 has assumed its prelocking position, an actuating pin 25 for the lever 3 comes to rest on a guide ridge 17 (the upper ridge or upper link thereof). When the lever 3 is in the prelocking position, it is ensured that further joining of the plug strip and the socket strip 2 is not possible without further motion of the lever 3. This is prevented by the guide ridge 17 aligned parallel, in particular the two parallel ridges thereof. Further joining is initially prevented by the actuating pin 25 fitting between the guide ridges 17. If the lever 3 is subsequently moved in the direction of the end locking position (see FIG. 3), the eccentric actuating pin 25 pulls the plug strip 1 and the socket strip 2 together by means of the guide ridge 17, in particular the lower part or ridge thereof.

When the end position is reached, an edge 32 of the lever 3 engages with the undercut of a friction-fit (or positive-fit) catch hook 13 formed unitarily with the body of the plug strip 1. A surface 14 also locks in the lever 3 in such a way that when the edge of the catch hook 13 is overloaded the plug strip 1, socket strip 2, and lever 3 become wedged inside one another by the fact that the surface 27 of the lever 3 pushes the plug strip 1 onto a coding tab 20 for the socket strip 2 as a result of the load on the surface 14 and the catch hook 13, in the direction of disassembly. In this case the lever 3 is supported on the plug strip 1 by a contact surface 9. To check whether the socket strip 2 is in the end position and to additionally ensure the mutual retention force of the plug-in connection, a ridge 18 and the stop 19 (bar on the socket strip), that is in the end position below the lever arm, are secured in position by the lever 3. The contact surface 9 on the plug strip 1 is likewise used to guide the lever 3.

Figure 7B:
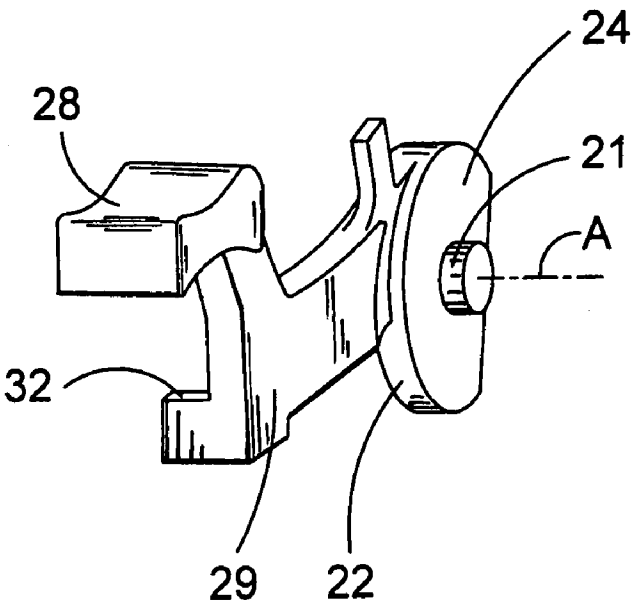
FIGS. 7A and 7B are perspective views showing the locking lever.
Figure 7A:
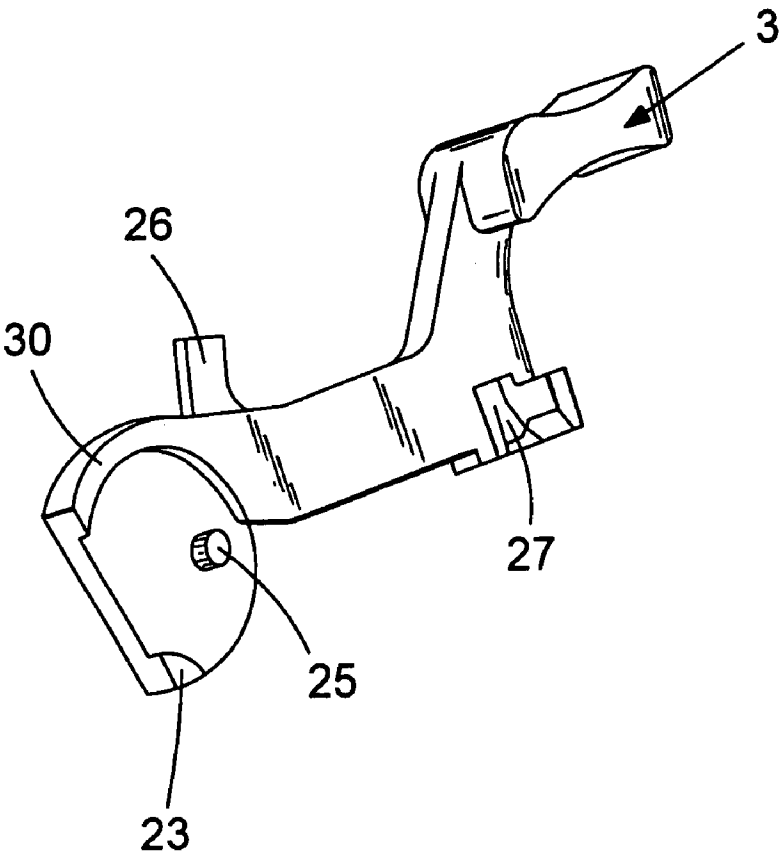

As a result of the cooperation of the surface 27 (see FIG. 7) with the parts 9, 12, 13, and 14 of the plug strip 1 the lever 3 is not released until the locking formations 12—are is pushed longitudinally against the plug strip 1, and the handle region 3 is twisted out of the longitudinal plane of the plug strip 1. In the design shown, the locking is designed as multiple locking. However, the locking may also be designed as two-stage locking.

When the plug strip 1 and socket strip 2 are separated, i.e. during a disassembly procedure, the bracket on the actuating projection 12 that comprises the edge of the catch hook 13 and the undercut 14 and that is elastically mounted on the plug strip 1 and the actuating projection 12 is actuated, and at the same time the lever 3 is pushed or deflected opposite the direction D on a handle region 28 toward the prelocking position of the lever. When the lever 3 is no longer engaged with the catch hook 13 via the projection 32 on the lever, the lever 3 may be brought to the prelocking position without actuating the surface 12. The actuating pin 25 presses on the upper ridge (the upper link) of the guide ridge 17 and moves the socket strip 2 out of the plug strip 1, in the direction of disassembly of the plug strip. In other words, during disassembly (separation) the involved elements move backward, starting at FIG. 3 and progressing to FIG. 1. If the lever 3 is in its prelocking position in a manner analogous to FIG. 2, the socket strip 2 may be removed from the plug strip 1 (FIG. 1).

We claim:

1. An electrical connector comprising:

a multiconductor plug strip having a pair of longitudinally extending side walls having substantially parallel confronting faces and defining a longitudinally extending and transversely open slot, one of the side walls being formed with a recess open toward the other of the side walls;

a multiconductor socket strip fittable complementarily and transversely between the side walls of the plug strip;

a pivot seat in the recess open toward the other side wall and defining a pivot axis;

a lever having a foot fittable into the recess and formed with a transversely projecting pivot fittable with the seat for pivoting of the lever on the plug strip about the axis, the lever and socket strip being of such transverse thickness that when the socket strip is in the slot and the lever foot is in the recess the pivot cannot pull out of the pivot seat;

an actuating formation on the lever offset from the axis projecting transversely toward the other of the side walls; and another actuating formation on the socket strip engageable with the lever actuating formation and displaceable thereby when the other strip is at least partially fitted to the one strip to disengage and engage the strips with each other.

2. The electrical strip connector defined in claim 1, further comprising means including interengaging latching formations on the plug strip and lever for locking the lever in a retaining position holding the socket strip fitted to the plug strip.

3. The electrical strip connector defined in claim 2 wherein at least one of the latching formations is elastically deformable for unlocking the lever.

4. The electrical strip connector defined in claim 1 wherein the lever has an outer end and the plug strip is provided with an abutment engageable between the outer end and the pivot of the lever when the socket strip is fitted to the plug strip.

5. The electrical strip connector defined in claim 1 wherein the plug strip has guide surfaces bearing radially and axially of the axis on complementary surfaces of the lever.

6. The electrical strip connector defined in claim 5 wherein the lever foot is part-circular and centered on the axis and formed with the respective surfaces.

7. The electrical strip connector defined in claim 6 wherein the foot is shaped such that the lever can only be fitted to the strip on one angular orientation of the lever relative to the plug strip.

8. The electrical strip connector defined in claim 1 wherein the actuating formations on the plug strip are a pair of ridges extending parallel to each other and generally tangentially of the axis.

9. The electrical strip connector defined in claim 1 wherein the lever has a transversely projecting tab and the plug strip has a complementary hook that interengage when the strips are at least partially fitted together.

10. The electrical strip connector defined in claim 1 wherein the lever is formed unitarily of one piece with the foot and pivot and respective actuating formation.

11. The electrical strip connector defined in claim 1 wherein the plug strip is formed unitarily of one piece with the side walls.

12. The electrical strip connector defined in claim 1 wherein the pivot is a pin projecting transversely centrally from the foot.

* * * * *